US006889633B2

(12) United States Patent
Murakami et al.

(10) Patent No.: US 6,889,633 B2
(45) Date of Patent: May 10, 2005

(54) ENGINE COOLING SYSTEM

(75) Inventors: Nobuaki Murakami, Kyoto (JP); Tetsuro Ishida, Kyoto (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/325,880

(22) Filed: Dec. 23, 2002

(65) Prior Publication Data

US 2003/0116103 A1 Jun. 26, 2003

(30) Foreign Application Priority Data

Dec. 25, 2001 (JP) ..... 2001-391766

(51) Int. Cl.[7] ..... F01P 7/16
(52) U.S. Cl. ..... 123/41.1; 123/41.08
(58) Field of Search ..... 123/41.1, 41.44, 123/41.05

(56) References Cited

U.S. PATENT DOCUMENTS 4,616,599 A * 10/1986 Taguchi et al. ..... 123/41.1
4,759,316 A * 7/1988 Itakura ..... 123/41.08
5,390,632 A * 2/1995 Ikebe et al. ..... 123/41.1
5,742,920 A * 4/1998 Cannuscio et al. ..... 123/41.1
6,032,618 A * 3/2000 Ferrari et al. ..... 123/41.1
6,223,700 B1 * 5/2001 Sano et al. ..... 123/41.1
6,308,664 B1 * 10/2001 Ambros ..... 123/41.05

FOREIGN PATENT DOCUMENTS

JP 10-131753 A 5/1998

* cited by examiner

*Primary Examiner*—Marguerite McMahon
*Assistant Examiner*—Jason Benton
(74) *Attorney, Agent, or Firm*—Birch, Stewart, Kolasch & Birch, LLP

(57) ABSTRACT

There is provided an engine cooling system, in which operation tendency information calculating section provided in a control unit calculates values representing the tendency of engine operation, and a control valve provided in a cooling water circulating device is controlled based on the values. It is therefore possible to control the cooling water to a proper temperature conforming to the engine operating condition and improve both the engine power and the fuel economy.

14 Claims, 4 Drawing Sheets

ENGINE COOLING SYSTEM

CROSS REFERENCE TO RELATED APPLICATION

This non-provisional application incorporates by reference the subject matter of Application No. 2001-391766 filed in Japan on Dec. 25, 2001, on which a priority claim is based under 35 U.S.C. § 119(a).

BACKGROUND OF THE INVENTION

1. Field of the Invention

The present invention relates to an engine cooling system that can be suitably used for an automobile.

2. Description of the Related Art

An engine cooling system of carried by an automobile or the like has a function of circulating engine cooling water in a radiator to cool the cooling water so that the cooling water temperature can be maintained within a predetermined range. Therefore, the temperature of each part of an engine can be maintained within such a predetermined range that the engine functions properly.

In a conventional cooling system, a thermostat provided in a cooling water path controls the amount of cooling water flowing into a radiator so that the cooling water can be maintained at a predetermined temperature. More specifically, if the temperature of cooling water discharged from an engine is relatively low as in the case of low load operation, the amount of cooling water bypassing the radiator is increased to lower the proportion of cooling water cooled by the radiator to inhibit the cooling water from being cooled excessively. If the temperature of cooling water discharged from the engine is relatively high as in the case of high load operation, the thermostat automatically opens to increase the amount of cooling water flowing into the radiator to increase the proportion of cooling water cooled by the radiator so that the cooling water can be cooled sufficiently.

Incidentally, the cooling water is required to be maintained at a relatively high temperature in order to reduce friction loss and to improve fuel economy. On the other hand, the cooling water is required to be maintained at a relatively low temperature in order to improve the volume efficiency of intake air to inhibit the engine knock and increase engine power. Thus, if the cooling water is maintained at a relatively low temperature in the case of high load operation requiring excellent engine performance and is maintained at a relatively high temperature in the case of low load operation, both the engine power and the fuel economy can be improved. In the above-described conventional cooling system, however, the cooling water must be set to a low temperature with greater emphasis being placed on the engine power or to a high temperature with greater emphasis being placed on the fuel economy. Namely, only one of the engine power and the fuel economy can be improved.

Alternatively, use of an electronically controlled thermostat may be considered for the above-described engine cooling system to control the cooling water based on instantaneous values (e.g. engine load) of ever changing engine operation.

In this case, however, the cooling water temperature cannot be controlled properly in terms of medium and long term engine operating conditions, the driver's engine operation style (e.g. the operation style with greater emphasis being placed on the engine power and the operation style with greater emphasis being placed on the fuel economy), and so forth, and therefore, both the engine power and the fuel economy cannot be improved satisfactorily.

SUMMARY OF THE INVENTION

It is therefore an object of the present invention to provide an engine cooling system capable of improving both the engine power and the fuel economy.

To attain the above object, in a first aspect of the present invention, there is provided an engine cooling system comprising a cooling water circulating device that circulates cooling water for an engine, a regulating device provided in the cooling water circulating device for regulating cooling action on the engine by the cooling water, a cooling water temperature control section that controls the regulating device, and an operation tendency information calculating section that calculates a value representing the tendency of engine operation. The cooling water temperature control section controls the regulating device such that the cooling water has a lower temperature in a case where the value representing the tendency of the engine operation indicates the tendency to require more engine power than in a case where the value representing the tendency of the engine operation indicates the tendency to require less engine power.

To attain the above object, in a second aspect of the present invention, there is provided an engine cooling system comprising a cooling water circulating device that circulates cooling water for an engine, a regulating device provided in the cooling water circulating device for regulating cooling action on the engine by the cooling water, and a control unit that controls the regulating device based on a value representative of the tendency of engine operation.

To attain the above object, in a third aspect of the present invention, there is provided a method of controlling the temperature of cooing water in an engine cooling system comprising the step of calculating a value representative of the tendency of engine operation; and the step of controlling a regulating device, provided in an engine cooling water circulating device to regulate the cooling action on an engine, based on the calculated value representing the tendency of the engine operation.

BRIEF DESCRIPTION OF THE DRAWINGS

The nature of this invention, as well as other objects and advantages thereof, will be explained in the following with reference to the accompanying drawings, in which like reference character designate the same or similar parts throughout the figures and wherein.

DETAILED DESCRIPTION OF THE INVENTION

The present invention will now be described in detail with reference to the accompanying drawings showing preferred embodiments thereof. It is to be understood, however, that the dimensions, materials, shapes, and arrangements of component parts should not be restricted to the following embodiments, but changes within the purview of the appended claims may be made without departing from the true scope.

Figure 1:
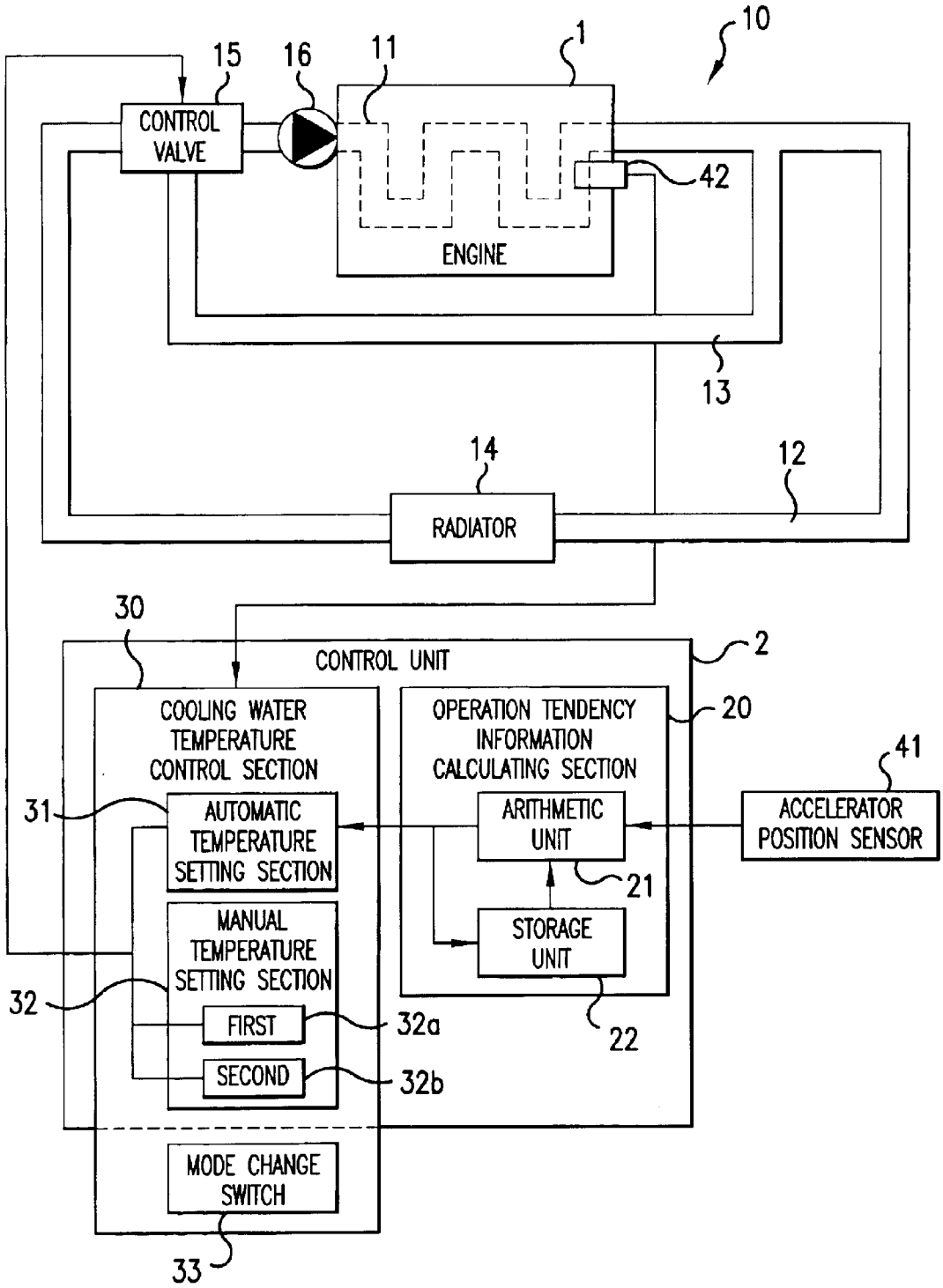
FIG. 1 is a conceptual diagram showing the entire construction of an engine cooling system according to first and second embodiments of the present invention.

FIG. 1 illustrates an engine cooling system according to a first embodiment of the present invention. This engine cooling system is comprised of an engine 1, a cooling water circulating device 10 that forms an annular cooling water path including a water jacket 11 of the engine 1, a control unit 2, an accelerator position sensor 41 disposed at such a position as to detect an angle of an accelerator pedal depression or an angle of a throttle valve opening of the engine 1 and outputs a signal (hereinafter, "accelerator angle") to an operation tendency information calculating section 20 of the control unit 2, a water temperature sensor 42 disposed at such a position as to contact the cooling water near an outlet of the engine 1 and outputs a water temperature signal to a cooling water temperature control section 30 of the control unit 2, and so forth.

The cooling water circulating device 10 is comprised of the water jacket 11 as a cooling water path of the engine 1, a radiator 14 disposed at such a position as to catch the driving air and the air from a cooling fan, a radiator path 12 that connects a cooling water inlet and outlet of the water jacket 11 with the radiator 14 to form the annular (closed) cooling water path in cooperation with the water jacket 11, a bypass path 13 as a cooling water path that branches from the radiator path 12 to bypass the radiator 14, a control valve 15 disposed at a position where the radiator path 12 and the bypass path 13 meet upstream of the water jacket 11 and is comprised of an electronically controlled thermostat or the like to receive a signal from the cooling water temperature control section 30, a water pump 16 disposed at the cooling water inlet of the water jacket 11, and so forth.

The control unit 2 is a computer that controls the engine 1, and includes the essential parts of the operation tendency information calculating section 20 and the cooling water temperature control section 30. The operation tendency information calculating section 20 comprises an arithmetic unit 21, a storage unit 22, and the like. The arithmetic unit 21 outputs a signal to an automatic temperature setting section 31 of the cooling water temperature control section 30 in response to a signal from the accelerator position sensor 41. The cooling water temperature control section 30 comprises the automatic temperature setting section 31, a manual temperature setting section 32, a mode change switch 33, and so forth, and outputs a signal to the control valve 15 in response to a signal from the water temperature sensor 42. The automatic temperature setting section 31 receives a signal from the arithmetic unit 21 of the operation tendency information calculating section 20. The manual temperature setting section 32 comprises a first manual temperature setting section 32*a*, a second manual temperature setting section 32*b*, and the like. The mode change switch 33 of the cooling water temperature control section 30, however, is not disposed in the control unit 2, but is disposed at such a position as to be operated by the driver, e.g. in the vicinity of a driver seat, and is configured such that the driver can select the following three modes: "Low", "High," and "Auto."

The water jacket 11 transfers heat generated in each part of the engine 1 to the cooling water in the water jacket 11 to cool each part of the engine 1. The water pump 16 functions as a pump that circulates the cooling water in the cooling water circulating device 10. The radiator 14 is a heat exchanger that transfers heat of the cooling water to the peripheral air to cool the cooling water. The cooling water, circulating in the radiator path 12, is cooled by the radiator 14.

On the other hand, the cooling water, circulating in the bypass path 13 that bypasses the radiator 14, is not cooled. The control valve 15 functions as a regulator capable of regulating the cooling action on the engine by the cooling water. More specifically, the control valve 15 operates to regulate the amount of the cooling water circulating in each of the radiator path 12 and the bypass path 13 according to a signal outputted from the cooling water temperature control section 30. Namely, if the control valve 15 increases the amount of cooling water circulating in the radiator path 12, the percentage of the cooling water cooled by the radiator 14 is increased to sufficiently cool the cooling water, and if the control valve 15 increases the amount of cooling water circulating in the bypass path 13, the percentage of cooling water cooled by the radiator 14 is decreased to such an extent that the cooling water is hardly cooled. With this arrangement of the cooling water circulating device 10, the heat generated in the engine 1 is transferred to the outside of the engine 1 by the cooling water. The cooling water having absorbed the heat circulates in the cooling water circulating device 10, and the regulation of the cooling action controls the cooling water to a temperature set by the cooling water temperature control section 30.

The accelerator position sensor 41 detects information indicative of the accelerator angle of the engine 1, and outputs the detected accelerator angle information to the operation tendency information calculating section 20. The accelerator angle information is information indicative of engine load. Examples of values representing the tendency of the engine operation are values representing the tendency of the engine load. To control the cooling water temperature, the engine cooling system according to the first embodiment uses a value representing the load change among the values representing the tendency of the engine load. In calculating the value representing the change of rage in the load, the operation tendency information calculating section 20 refers to the accelerator angle information outputted from the accelerator position sensor 41.

The operation tendency information calculating section 20 has a function of calculating the values representing the tendency of the engine operation, and calculates the value representing the load change based on the engine load information acquired as a voltage signal from the accelerator position sensor 41. The load change is a parameter based on which the engine operating condition can be estimated. If the load change is high, it is estimated that the driver is driving the automobile speedily (aggressively) while repeating rapid acceleration. To the contrary, if the load change is small, it is estimated that the driver is driving the automobile carefully or slowly with a few accelerations or decelerations. Further, the value representing the tendency of the load change calculated based on the load change is a parameter for estimating the medium and long term tendency of the engine operating condition and the driver's engine operating style. Generally, if the value representing the tendency of the load change is large, it is estimated that greater emphasis should be placed on the engine power during driving, and if the value representing the tendency of the load change is small, it is estimated that greater emphasis should be placed on the fuel economy during driving.

The arithmetic unit 21 provided in the operation tendency information calculating section 20 calculates the value representing the tendency of the load change, and calculates the load change per arithmetic operation control cycle according to the engine load information inputted sequentially from the accelerator position sensor 41. Values representing the tendency of the previously calculated load change are tempered with absolute values of the calculated load change to calculate a value representing the tendency of the latest load change. For example, the value representing the tendency of the load change is represented by the following expression:

The value representing the tendency of the load change (current)=(1-k)×the value representing the tendency of the load change (previous)+k×|d(accelerator position sensor output)/dt|(current measured value), where 0<k<1, "d( )/dt" indicates the differentiation with respect to time (the rate of change), and "| |" indicates the absolute value.

In the present embodiment, the value representing the tendency of the load change represented by the above expression is used as a value representing the tendency of the engine operation. A value representing the latest tendency of the load change is outputted to the storage unit 22 of the operation tendency information calculating section 20 and the automatic temperature setting section 31 of the cooling water temperature control section 30. The storage unit 22 stores the values representing the tendency of the load change, and is implemented by a nonvolatile memory. The storage unit 22 is configured to receive the values representing the tendency of the load change, which are calculated per arithmetic operation control cycle by the arithmetic unit 21, and sequentially update the contents with the values representing the latest tendency of the load change. It should be noted that the arithmetic unit 21 reads the stored values representing the tendency of the load change when newly calculating the value representing the tendency of the load change. Namely, the arithmetic unit 21 reads the engine load information from the accelerator position sensor 41 to calculate the load change. At the same time, a value representing the most recent tendency of the load change, which is stored in the storage unit 22, is inputted to the arithmetic unit 21, and the arithmetic unit 21 newly calculates a value representing the tendency of the load change from the values representing the tendency of the latest load change and the most recent tendency of the load change.

The value representing the tendency of the load change, which is stored in the storage unit 22 at the end of driving of the vehicle, is used as an initial value representing the tendency of the load change and is outputted to the automatic temperature setting section 31 the next time when the vehicle is driven. In this way, both the arithmetic unit 21 and the storage unit 22 function to calculate the values representing the tendency of the load change, and the calculated values representing the tendency of the load change are used for estimating the medium and long term tendency of the engine operating condition and the driver's engine operation style.

The water temperature sensor 42 outputs information indicative of the temperature of the cooling water in the water jacket 11 as a voltage signal. When controlling the cooling water temperature, the cooling water temperature control section 30 uses the outputted temperature information.

By operating the mode change switch 33 of the cooling water temperature control section 30, the driver can select an automatic temperature setting mode in which the cooling water temperature is determined according to the estimated medium and long term tendency of the engine operating condition and the estimated driver's engine operation style, or a manual temperature setting mode in which the cooling water temperature is controlled to a predetermined temperature according to the preference of the driver. The cooling water temperature control section 30 selects and operates the temperature setting sections 31*a*, 32*a*, 32*b*, which set different cooling water temperatures, according to the mode selected using the mode change switch 33, and controls the operation of the control valve 15 such that the actual cooling water is maintained at the cooling water temperature set by the temperature setting sections 31, 32*a*, 32*b*.

When the "Low" mode is selected by using the mode change switch 33, the cooling water temperature control section 30 selects and operates the first manual temperature setting section 32*a* of the manual temperature setting section 32. The cooling water temperature is set to a first predetermined temperature (T1), which is relatively low, so that the cooling water temperature is controlled to a relatively low temperature suitable-for the operating condition in which greater emphasis is placed on the engine power (first manual temperature setting mode).

When the "High" mode is selected by using the mode change switch 33, the cooling water temperature control section 30 selects and operates the second manual temperature setting section 32*b* of the manual temperature setting section 32. The cooling water temperature is set to a second predetermined temperature ($T_2$), which is relatively high, so that the cooling water temperature is controlled to a relatively high temperature suitable for the operating condition in which greater emphasis is placed on the fuel economy (second manual temperature setting mode).

When the "Auto" mode is selected by using the mode change switch 33, the cooling water temperature control section 30 selects and operates the automatic temperature setting section 31. The cooling water temperature is set to a temperature conforming to the value representing the tendency of the load change, so that the cooling water temperature is automatically controlled to the optimum temperature according to the estimated medium and long term tendency of the engine operating condition and driver's engine operation style (automatic temperature setting mode).

When the actual cooling water temperature obtained from the water temperature sensor 42 is higher than the set cooling water temperature, the cooling water temperature control section 30 provides control such that the control valve 15 increases the amount of the cooling water circulating in the radiator path 12. When the actual cooling water temperature obtained from the water temperature sensor 42 is lower than the set cooling water temperature, the cooling water temperature control section 30 provides control such that the control valve 15 increases the amount of the cooling water circulating in the bypass path 13. This maintains the cooling water temperature approximate to the set temperature. Although the cooling water temperature control section 30 of the first embodiment provides feedback control based on the actual cooling water temperature obtained from the water temperature sensor 41 as mentioned above, this is not limitative thereto. For example, the relation between the percentage of the cooling water flowing in each of the radiator path 12 and the bypass path 13 and the actual cooling water temperature may be found on an experimental basis, and the cooling water temperature control means 30 may store the relation to provide an open loop control to notify the control valve 15 of the operational amount suitable for the set cooling water temperature.

Figure 4:
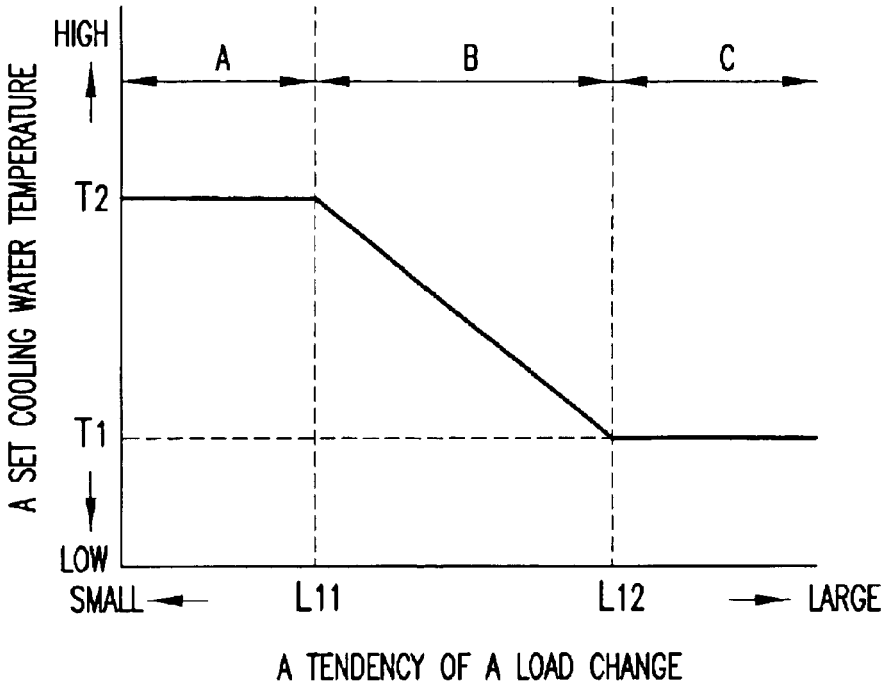
FIG. 4 is a graph showing the relation between values representing the tendency of the load change and the set cooing water temperature according to the first embodiment.

FIG. 4 shows the relationship between the values representing the tendency of the load change and the set cooling water temperatures in a case where the "Auto" mode, i.e. the automatic temperature setting mode, is selected by using the mode change switch 33 according to the present embodiment. When the value representing the tendency of the load change is equal to or smaller than a first predetermined value ($L_1$) which is relatively small, the cooling water temperature is set to a second predetermined temperature ($T_2$) (section A), so that the set cooling water temperature is equal to the one in a case where the "High" mode, i.e. the second manual temperature setting mode, is selected by using the mode change switch 33. When the value representing the tendency of the change of rate in the load is larger than the first predetermined value ($L_1$), the cooling water temperature is set to a lower temperature for the larger value representing the tendency of the change of rate in the load (section B). Further, when the value representing the tendency of the change of rate in the load is larger than a second predetermined value ($L_2$) which is relatively large, the cooling water temperature is set to the first predetermined temperature ($T_1$) (section C), so that the set cooling water temperature is equal to the one in a case where the "Low" mode, i.e. the first manual temperature setting mode, is selected by using the mode change switch 33.

It should be noted that the relation between the value representing the tendency of the load change and the set cooling water temperature is stored as map information in the automatic temperature setting section 31. In the case where the "Auto" mode, i.e. the automatic temperature setting mode, is selected by using the mode change switch 33, the medium and long term tendency of the engine operating condition and the driver's engine operation style are estimated according to the value representing the tendency of the load change, and the automatic temperature setting means 31 determines whether greater emphasis should be placed on the engine power or the fuel economy. If it is determined that greater emphasis should be placed on the engine power, the automatic temperature setting section 31 sets the cooling water temperature to a relatively low temperature at which the intake air volume efficiency can be improved and the engine knock can be inhibited. To the contrary, if it is determined that greater emphasis should be placed on the fuel economy, the automatic temperature setting section 31 sets the cooling water temperature to a relatively high temperature at which the friction loss can be reduced and the fuel economy can be improved.

Figure 2:
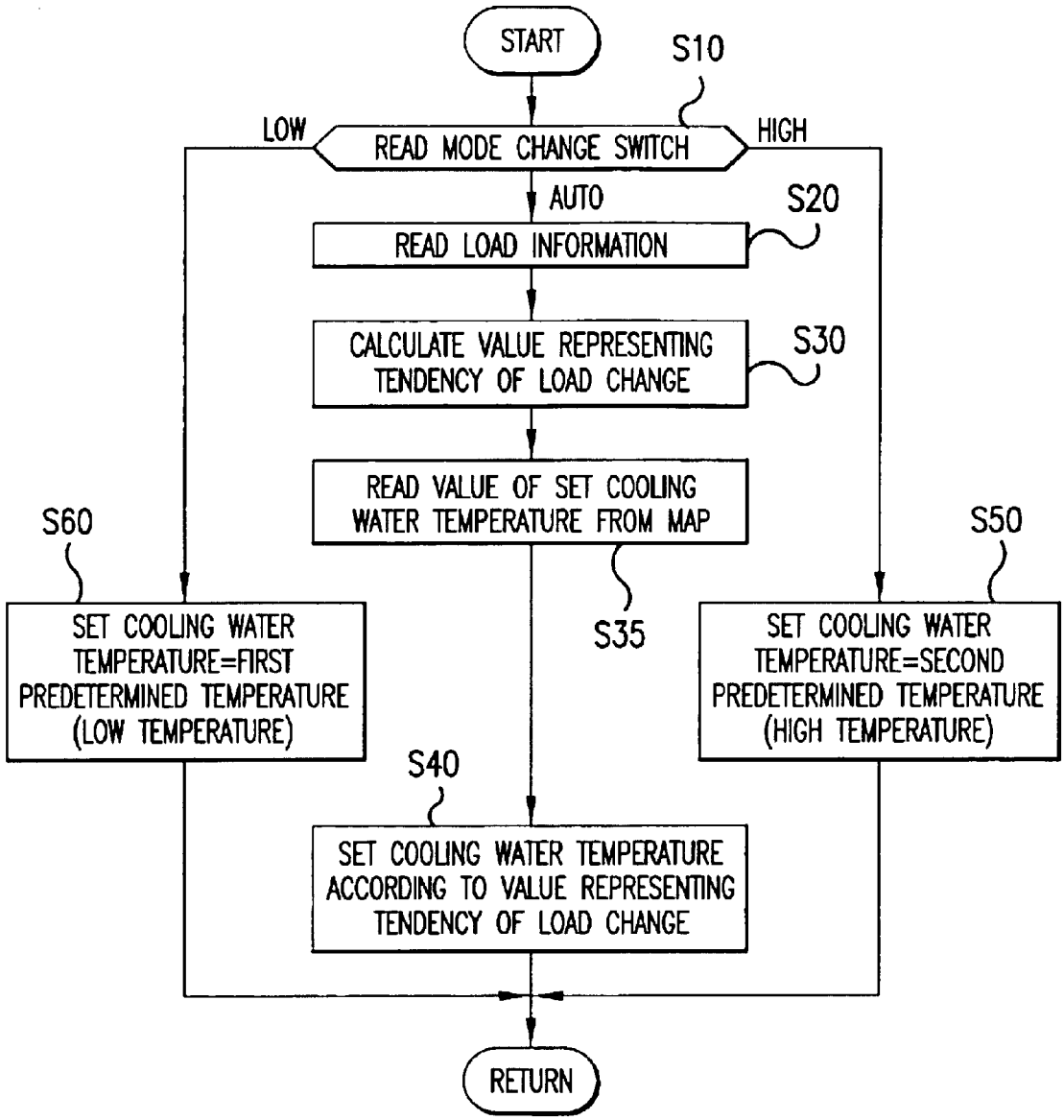
FIG. 2 is a flow chart that shows an operation of the engine cooling system according to the first embodiment.

According to the present embodiment, the cooling water temperature is set according to the procedure shown in the flow chart of FIG. 2. To set the cooling water temperature, the cooling water temperature control section 30 reads information on the mode selected by using the mode change switch 33 (Step S10). In a case where the selected mode is the second manual setting mode (High), the cooling water temperature control section 30 selects and operates the second manual temperature setting section 32*b* such that the cooling water temperature can be set to the second predetermined temperature ($T_2$) (Step S50).

In a case where the selected mode is the first manual setting mode (Low), the cooling water temperature control section 30 selects and operates the first manual temperature setting section 32*b* such that the cooling water temperature can be set to the second predetermined temperature ($T_1$) (Step S60). In either case, the manual temperature setting mode is selected in which the cooling water temperature is controlled to a predetermined temperature according to the preference of the driver or the like, and the cooling water temperature is controlled to a relatively low temperature suitable for the operating condition in which greater emphasis should be placed on the engine power or a relatively high temperature suitable for the engine operating condition in which greater emphasis should be placed on the fuel economy.

On the other hand, in a case where a mode signal indicates the automatic temperature setting mode (Auto) in the Step S10, the cooling water temperature control section 30 selects and operates the automatic temperature setting section 31. First, the operation tendency information calculating section 20 reads information indicative of the engine load from the accelerator position sensor 41 (Step S20), and calculates the engine load change to obtain the value representing the tendency of the load change (Step S30). The automatic temperature setting section 31 then reads the cooling water temperature conforming to the value representing the tendency of the load change, which is to be set, from the map stored in advance (Step S35). The map contains the relationship shown in FIG. 4 as mentioned above. Finally, the automatic temperature setting means 31 updates the value read from the map as the set cooling water temperature (Step S40), and the cooling water temperature is controlled based on the set cooling water temperature.

As described above in detail, the engine cooling system according to the present embodiment controls the cooling water temperature based on the value representing the tendency of the load change, i.e. the value representing the tendency of the engine operation as the parameter for estimating the medium and long term engine operating condition and the driver's engine operation style, thus controlling the cooling water temperature to a temperature suitable for the engine operating condition. Even when the medium and long term engine operating condition and the driver's engine operation style are changed due to a change in the road condition or a replacement of drivers, it is estimated whether the greater emphasis should be placed on the engine power or the fuel economy according to the value representing the tendency of the engine operation, so that the cooling water temperature is controlled to a proper temperature.

Further, since the cooling water temperature is controlled based on the value representing the tendency of the engine operation, the setting as to the cooling water temperature is prevented from being changed improperly as in a case where the cooling water temperature is controlled based on a never changing parameter. Therefore, the cooling water temperature is controlled to a temperature suitable for the engine operating condition, the setting as to the cooling water temperature is never changed improperly, and both the fuel economy and the engine power can be improved.

A description will now be given with regard to an engine cooling system according to a second embodiment of the present invention. Elements and parts corresponding to those of the first embodiment are denoted by the same reference numerals, and a description thereof is omitted herein.

The structure of the engine cooling system according to the second embodiment is identical to that of the engine cooling system according to the first embodiment (FIG. 1).

Figure 5:
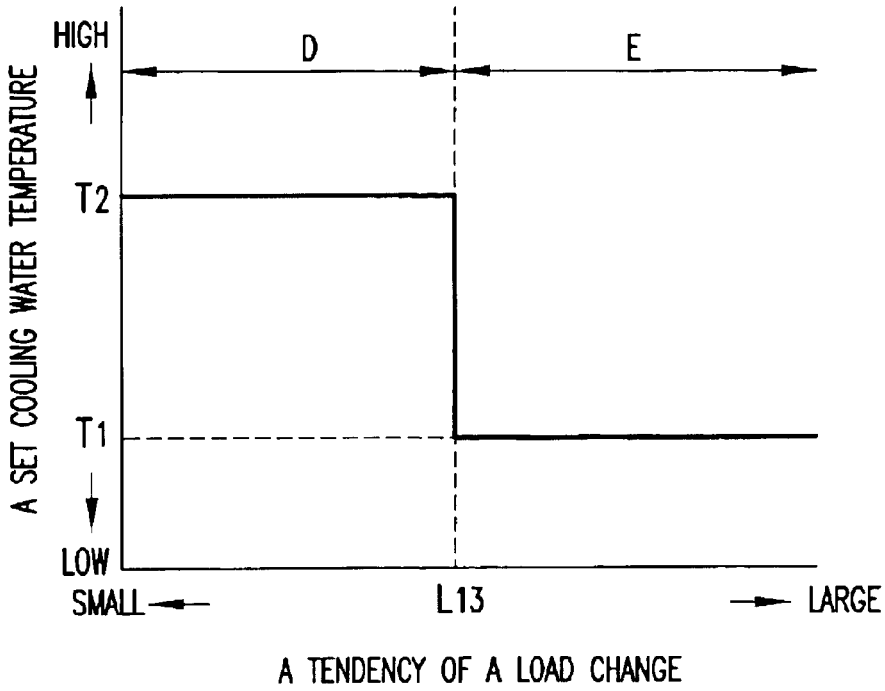
FIG. 5 is a graph showing the relation between values representing the tendency of the load change and the set cooing water temperature according to the second embodiment.

As shown in FIG. 5, the second embodiment is different from the first embodiment in the relation between the values representing the tendency of the load change and the set cooling water temperatures in the case where the "Auto" mode, i.e. the automatic temperature setting mode, is selected by using the mode change switch 33 in Step S10. Specifically, when the value representing the tendency of the load change is larger than a predetermined value ($L_3$), the cooling water temperature is set to the first predetermined temperature ($T_1$) (section E), so that the set cooling water temperature is equal to the one in a case where the "Low" mode, i.e. the first manual temperature setting mode, is selected by using the mode change switch 33. When the value representing the tendency of the load change is equal to or smaller than the predetermined value ($L_3$), the cooling water temperature is set to the second predetermined temperature ($T_2$) (section D), so that the set cooling water temperature is equal to the one in a case where the "High" mode, i.e. the second manual temperature setting mode, is selected by using the mode change switch 33. Namely, the set cooling water temperature according to the first embodiment has a range in which it gradually changes between the first predetermined temperature ($T_1$) and the second predetermined temperature ($T_2$), whereas the set cooling water temperature according to the second embodiment is equal to only one of the first predetermined temperature ($T_1$) or the second predetermined temperature ($T_2$).

Thus, according to the second embodiment, in the case where the "Auto" mode, i.e. the automatic temperature setting mode, is selected by using the mode change switch 33, the medium and long term tendency of the engine operating condition and the driver's engine operation style are estimated according to the value representing the tendency of the load change, and the automatic temperature setting means 31 determines whether greater emphasis should be placed on the engine power or the fuel economy. If it is determined that greater emphasis should be placed on the engine power, the automatic temperature setting section 31 sets the cooling water temperature to a relative low temperature at which the intake air volume efficiency can be improved and the engine knock can be inhibited. To the contrary, when it is determined that greater emphasis should be placed on the fuel economy, the automatic temperature setting section 31 sets the cooling water temperature to a relative high temperature at which the friction loss can be reduced and the fuel economy can be improved.

Figure 3:
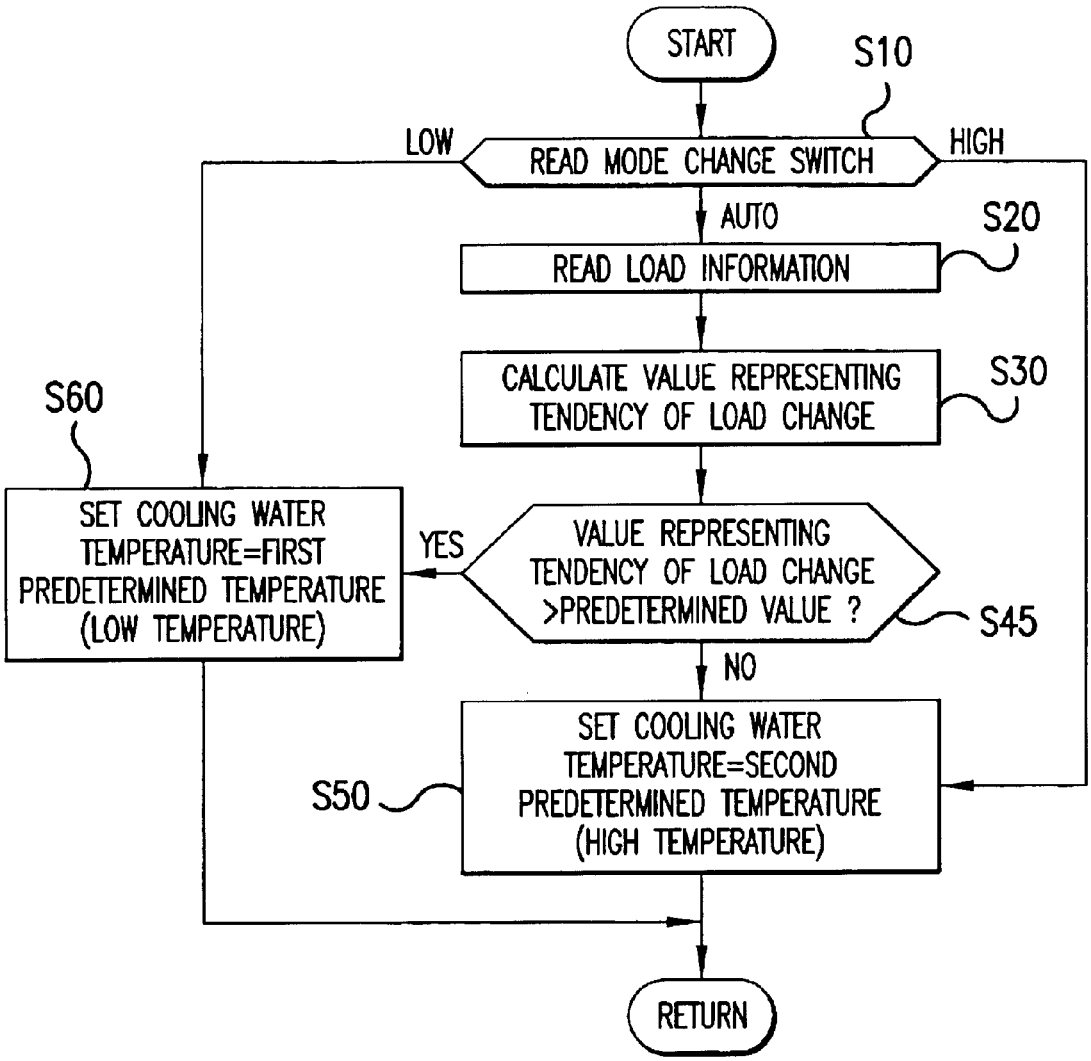
FIG. 3 is a flow chart that shows an operation of the engine cooling system according to the second embodiment.

In the second embodiment, the cooling water temperature is set according to the procedure shown in the flow chart of FIG. 3. Steps S10, S20, and S30 are identical with those of the first embodiment. In the second embodiment, the automatic temperature setting section 31 determines the cooling water temperature to be set based on the value representing the tendency of the load change (Step S45). Specifically, when the value representing the tendency of the load change is larger than the predetermined value ($L_3$), the process proceeds to Step S60 wherein the cooling water temperature is set to the first predetermined temperature ($T_1$). When the value representing the tendency of the load change is equal to or smaller than the predetermined value ($L_3$), the process proceeds to Step S50 wherein the cooling water temperature is set to the second predetermined temperature ($T_2$). The cooling water temperature is controlled based on the set cooling water temperature.

Therefore, according to the second embodiment, both the engine power and the fuel economy can be improved by properly controlling the cooling water temperature as is the case with the first embodiment.

Although the present invention has been described in detail byway of illustration for purposes of clarity of understanding, it will be apparent that certain changes and modifications may be practiced within the scope of the invention.

Although in the above-described embodiment, the value representing the tendency of the load change is used as the value representing the tendency of the engine operation, this is not limitative thereto, but other parameters may be used as the value representing the tendency of the engine operation. For example, in a case where a value representing the tendency of the engine load itself, not the load change, is used as the value representing the tendency of the engine operation, it is estimated that greater emphasis should be placed on the engine power if the value representing the tendency of the engine load is small. In a case where a value representing the tendency of the engine speed is used as the value representing the engine operation tendency, it is estimated that greater emphasis should be placed on the engine power if the value representing the tendency of the engine speed is large. In this way, the value representing the tendency of the engine load and the value representing the tendency of the engine speed may be used as parameters for estimating the medium and long term tendency of the engine operating condition and the driver's engine operation style.

Further, the parameters that can be used as the value representing the engine operation tendency may be not only information indicative of the engine, but also information indicative of a vehicle. For example, if a brake is used frequently or a vehicle is accelerated rapidly, it is estimated that the driver repeats rapid acceleration and drives the vehicle aggressively. To the contrary, if the brake is not used frequently or the acceleration of the vehicle is small, it is estimated that the driver carefully or slowly drives the vehicle with few accelerations or decelerations. Therefore, in a case where the frequency in the use of the brake is used as the value representing the engine operation tendency, it is estimated that greater emphasis should be placed on the engine power when the frequency in the use of the brake is high, and it is estimated that greater emphasis should be placed on the fuel economy when the frequency in the use of the brake is low.

In a case where a value representing the tendency of the vehicle acceleration is used as the value representing the tendency of the engine operation, it is estimated that greater emphasis should be placed on the engine power when the value representing the tendency of the vehicle acceleration is large, and it is estimated that greater emphasis should be placed on the fuel economy when the value representing the tendency of the vehicle acceleration is small. In this way, the values representing the frequency in the use of the brake and the tendency of the vehicle acceleration may be used as the parameters for estimating the medium and long term tendency of the engine operating condition and the driver's engine operation style.

It should be noted that throttle angle information obtained from a throttle position sensor, intake pipe pressure information obtained from an intake pipe pressure sensor, and intake air volume efficiency information obtained from an air flow sensor, and so forth as well as the accelerator angle information obtained from the accelerator position sensor 41 may be used as the information indicative of the engine load for use in calculating the tendency of the load change.

Further, although in the above described embodiment, the control valve 15, as the regulating device capable of regulating the cooling action on the engine by the cooling water, is disposed at the inlet side of the engine 1 in the cooling water circulating device 10, this is not limitative thereto, but the control valve 15 may be disposed at the outlet side of the engine 1.

Further, although in the above-described embodiment, the control valve 15 is used as the regulating device, the regulating device should not be limited to the control valve 15. For example, the radiator 14 may function as the regulating device if the radiator 14 is provided with an electric fan and the degree of cooling to which the cooling water is cooled by the radiator 14 is varied by changing the strength of the air blow from the fan or switching on/off the air blow from the fan.

Alternatively, an electric water pump 16 with variable revolutionary speed may function as the regulating device if the discharge from the water pump 16 can be arbitrarily varied.

It should be noted that the two or three elements of the radiator 14, the control valve 15, and the water pump 16 may be used singly or in combination to function as the regulating device.

Further, the same effects can also be achieved by a variation of the second embodiment in which a third predetermined temperature, a fourth predetermined temperature, or the like is used in addition to the first and second predetermined temperatures, and changing the setting as to the cooling water temperature on other stages. Although in the above described embodiment, the manual temperature setting mode is the two stage mode (i.e. "Low" and "High"), a one stage manual temperature setting mode may be used such that the mode is switched in two stages between an automatic temperature setting mode (Auto) and a manual temperature setting mode (Manual).

What is claimed is:

1. An engine cooling system, comprising:

a cooling water circulating device that circulates cooling water for an engine;

a regulating device provided in said cooling water circulating device for regulating a cooling action on the engine by the cooling water;

an operation tendency information calculating section that calculates a value representing a tendency of engine operation; and a cooling water temperature control section that controls said regulating device such that at least a first desired temperature and a second desired temperature are used for the cooling water temperature, wherein said first desired temperature is used as the cooling water temperature in a case where the value representing the tendency of the engine operation is a value representing a tendency to require more engine power and said second desired temperature is used as the cooling water temperature in a case where the value representing the tendency of the engine operation is a value representing a tendency to require less engine power.

2. An engine cooling system according to claim 1, wherein the value representing the tendency of the engine operation is a value representing a tendency of load on the engine.

3. An engine cooling system according to claim 2, wherein the value representing the tendency of the load is a value representing a tendency of engine load change.

4. An engine cooling system according to claim 3, wherein the value representing the tendency of load change is represented by:

L (current)=(1−k)×L(previous)+k×absolute value of the load change (current measured value), where "L" is the value representing the tendency of the load change, and "k" is a constant in a range of 0 to 1.

5. An engine cooling system according to claim 1, wherein said cooling water temperature control section controls said regulating device such that the temperature of the cooling water becomes lower as the value representing the tendency of the engine operation indicates a tendency to require more engine power.

6. An engine cooling system according to claim 1, wherein said first desired temperature is a temperature that is lower than said second temperature.

7. An engine cooling system according to claim 1, wherein said regulating device is a control valve that regulates an amount of the cooling water flowing in a bypass path that bypasses a radiator of said cooling water circulating device, and said cooling water temperature control section controls the control valve that regulates the amount of the cooling water flowing in the bypass path such that the cooling water has a temperature conforming to the value representing the tendency of the engine operation.

8. An engine cooling system according to claim 1, wherein said cooling water temperature control section comprises:

a mode change switch that selectively switches a temperature setting mode between an automatic temperature setting mode and a manual temperature setting mode;

an automatic temperature setting section that controls said regulating device such that the cooling water has a temperature conforming to the value representing the tendency of the engine operation in a case where the automatic temperature setting mode is selected using said mode change switch; and a manual temperature setting section that controls said regulating device such that the cooling water has a predetermined temperature not conforming to the value representing the tendency of the engine operation in a case where the manual temperature setting mode is selected using said mode change switch.

9. An engine cooling system according to claim 8, wherein:

said mode change switch selectively switches the manual temperature setting mode between a first manual temperature setting mode and a second manual temperature setting mode;

and said manual temperature setting section includes, a first manual temperature setting section that controls said regulating device such that the cooling water has a first predetermined temperature in a case where the first manual temperature setting mode is selected using said mode change switch, and a second manual temperature setting section that controls said regulating device such that the cooling water has a second predetermined temperature higher than the first predetermined temperature in a case where the second manual temperature setting mode is selected using said mode change switch.

10. An engine cooling system, comprising:

a cooling water circulating device that circulates cooling water for an engine;

a regulating device provided in said cooling water circulating device to regulate a cooling action on the engine by the cooling water; and a control unit that controls said regulating device such that at least a first desired temperature and a second desired temperature are used as the cooling water temperature according to a value representing a tendency of engine operation.

11. A method of controlling a temperature of cooling water in an engine cooling system, comprising:

calculating a value representing a tendency of engine operation;

setting a temperature of the cooling water based on said calculated value, said setting step using at least a first desired temperature and a second desired temperature to set the cooling water temperature according to the calculated value; and controlling a temperature of the cooling water conforming to said set temperature.

12. The method of controlling a temperature of cooling water in an engine cooling system according to claim 11, further comprising:

detecting engine load information, wherein the value representing of the tendency of the engine operation is calculated based on the detected load information.

13. The method of controlling a temperature of cooling water in an engine cooling system according to claim 11, further comprising:

detecting engine load information, wherein said calculation step includes the step of calculating an engine load change based on the detected engine load information, and the value representing the tendency of the engine operation is calculated based on the calculated load change.

14. The method of controlling a temperature of cooling water in an engine cooling system according to claim 13, further comprising:

reading a value of a cooling water temperature corresponding to a tendency of engine load change from a map, wherein in said control step includes the step of calculating the temperature of the cooling water based on the value read from the map.

* * * * *